US005154014A

United States Patent [19]

Groy et al.

[11] Patent Number: 5,154,014

[45] Date of Patent: Oct. 13, 1992

[54] DYNAMIC REFLECTIVE IMAGE DISPLAY APPARATUS ROTATING COLOR TUBE DISPLAY HAVING ADJACENT REFLECTOR ARRANGEMENT

[76] Inventors: A. David Groy, 231 Birch La., Lakeland, Fla. 33813-3502; Gerald Spickard, 235 Birch La., Lakeland, Fla. 33813

[21] Appl. No.: 577,764

[22] Filed: Sep. 6, 1990

[51] Int. Cl.[5] ..... G09F 13/00

[52] U.S. Cl. ..... 40/431; 40/579; 40/563

[58] Field of Search ..... 40/431, 558, 579, 580, 40/441, 430, 502, 581, 545, 563, 452; 362/257

[56] References Cited

U.S. PATENT DOCUMENTS

| | | | |
|---|---|---|---|
| 75,086 | 3/1868 | Ware | 40/579 |
| 888,569 | 5/1908 | Zarella | 40/431 |
| 1,731,960 | 10/1929 | Wilson | 40/431 |
| 2,049,698 | 8/1936 | Fry | 40/441 |
| 2,175,072 | 10/1939 | Wompey | 40/432 |
| 2,220,262 | 11/1940 | Miller | 40/563 X |
| 2,293,106 | 8/1942 | Bourdakoff | 40/431 |
| 2,374,640 | 4/1945 | Paul | 40/431 |
| 2,795,068 | 6/1957 | Standard | 40/441 |
| 3,143,629 | 8/1964 | Appel et al. | 362/257 X |
| 4,835,661 | 5/1989 | Fogelberg et al. | 40/546 X |

FOREIGN PATENT DOCUMENTS

| | | | |
|---|---|---|---|
| 489223 | 1/1954 | Italy | 40/579 |
| 336240 | 10/1930 | United Kingdom | 40/579 |

*Primary Examiner*—Kenneth J. Dorner
*Assistant Examiner*—James M. Gardner
*Attorney, Agent, or Firm*—Charles S. McGuire

[57] ABSTRACT

Apparatus for enhancing a message comprises an elongated housing defiing an open front for releasable positioning of a first message panhel having opaque and transparent portions constituting the message of one's choice. A stationary fluorescent light tube is positioned within said housing. A multi-colored, translucent tubular sleeve is positioned for rotation about said light tube such that light passes through said sleeve to emit a seemingly moving array of colored lights. A trough-shaped reflective panel is positioned behind the light and sleeve within the housing such that light impinged upon its reflective surface is reflected to impinge upon the message panel to thereby appear through the transparent portions of the message panel and visually enhance the message. A second message panel which is translucent and textured may be placed behind the first message panel to make the light appearing therethrough seem patterned.

7 Claims, 2 Drawing Sheets

DYNAMIC REFLECTIVE IMAGE DISPLAY APPARATUS ROTATING COLOR TUBE DISPLAY HAVING ADJACENT REFLECTOR ARRANGEMENT

BACKGROUND OF THE INVENTION

This invention relates to apparatus designed to visually enhance a two-dimensional sign and, more particularly, to novel apparatus having a dynamic, multi-color, light emitting element positioned for impingment upon a translucent panel upon which a message may be imprinted. The translucent portions of the panel appear to be bright, moving colors such that the attention of passersby is stimulated thereby increasing the possibility that they will view the message imprinted thereon.

The art of visual stimulation has taken many forms, especially so in the commercial advertising business wherein it has become of utmost importance to strive for captivating an audience larger than one's competitors. Since today's consumer is constantly bombarded by advertisements, it takes an increasing amount of effort on the part of the advertiser to make his/her advertisement more striking and eye-catching to the public than ever before. Most signs, such as billboards, for example, are simply ignored by the majority unless it catches their eye. Past sign visual enhancement apparatus have combined bright color and movement and incorporated those known, eye-catching characteristics into the sign to be viewed. An example of such apparatus may be seen in U.S. Pat. No. 2,175,072 issued to Wompey on Oct. 3, 1936. The Wompey apparatus positions rotatable neon tubes 9 of various color and shape in a housing having a trough-shaped reflector panel positioned behind the tubes while a sign comprising a translucent plate 5 and opaque sheet 3 with openings 4 is positioned in front such that seemingly moving, colored light is emitted through plate 5 and openings 4 to define characters constituting the message. The message thus emitted includes the eye-catching characteristics mentioned above, i.e., it has both color and movement.

One obvious drawback of the '072 patent is the need to change the neon tubes 9 whenever different combinations of color are desired. Another drawback is the prohibitive expense of spiral neon tubes 9*a* when that type of spiraling color is desired.

It is a main object of the present invention to provide apparatus having the capability to enhance the eye-catching quality of a sign by utilizing both color and movement elements which are simple in design and use.

It is a further object to provide such apparatus in which the color attributing element is easily and quickly interchangeable with various other, like elements of differing colors and patterns.

It is another object of the present invention to provide such apparatus which, through its simple yet efficient design, is economically attractive to both manufacturer and consumer alike.

Other objects will in part be obvious and in part appear hereinafter.

SUMMARY OF THE INVENTION

In accordance with the foregoing objects, the invention comprises a linear housing adapted to receive and contain a stationary, tubular light positioned in front of a stationary reflective panel of parabolic configuration. A multi-colored, translucent tubular sleeve is provided for releasable positioning about, and in covering relation to, the light tube. Means are provided for rotation of the sleeve about the light tube such that moving, multi-colored light is emitted from the sleeve, as well as reflected from the adjacently positioned panel in the foreground, and impinged upon at least one panel positioned in front of the housing. A first panel includes transparent portions shaped as characters which define the desired message whereby the moving, colored light emits through the transparent portions of the panel to catch the eye of passersby who will hopefully read the message. An optional, second panel is translucent and textured such that when placed immediately behind the first panel, the light passing through it and the transparent portions of the first panel seems to appear patterned, for example, dotted.

DETAILED DESCRIPTION

Figure 1:
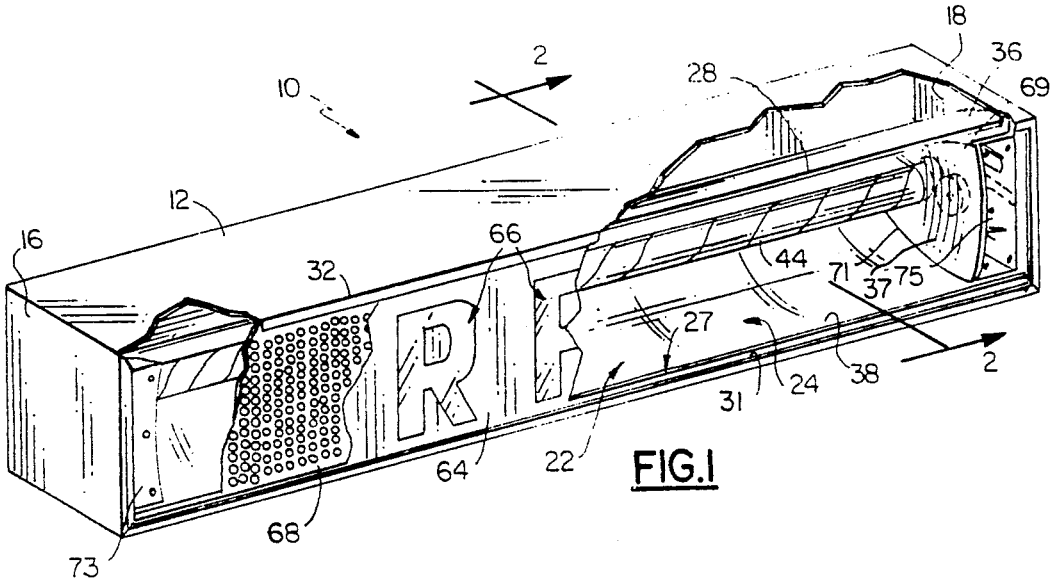
FIG. 1 is a perspective view of the invention showing portions of the housing and front panel partly broken away to reveal interior components of the housing.

Referring to the drawings, there is seen in the various Figures an elongated housing 10 of rectilinear configuration having a top wall 12, bottom wall 14, opposite side walls 16 and 18 and rear wall 20 defining an open front 22. A trough-shaped reflector panel 24 is fixedly secured within housing 10 with the panel middle crease 26 traversing the center of housing rear wall 20. The top and bottom, front longitudinal edges 28 and 30, respectively, of reflector panel 24 contact inner, flanged grooves 25 and 27 of top wall 12 and bottom wall 14, respectively. Reflector panel 24 may be made of any suitable reflective material such as aluminum, for example, and is somewhat flexible such that lengths 36 and 38 seen in FIG. 3 may bend concavely inward when panel 24 is secured in place within housing 10 as described above. A pair of reflective side panels 35 and 37 have respective slots 35' and 37' for placement around each end of sleeve 44 to complete the reflective enclosure for the rotating tube and light assembly as will be described more fully below.

Figure 2:
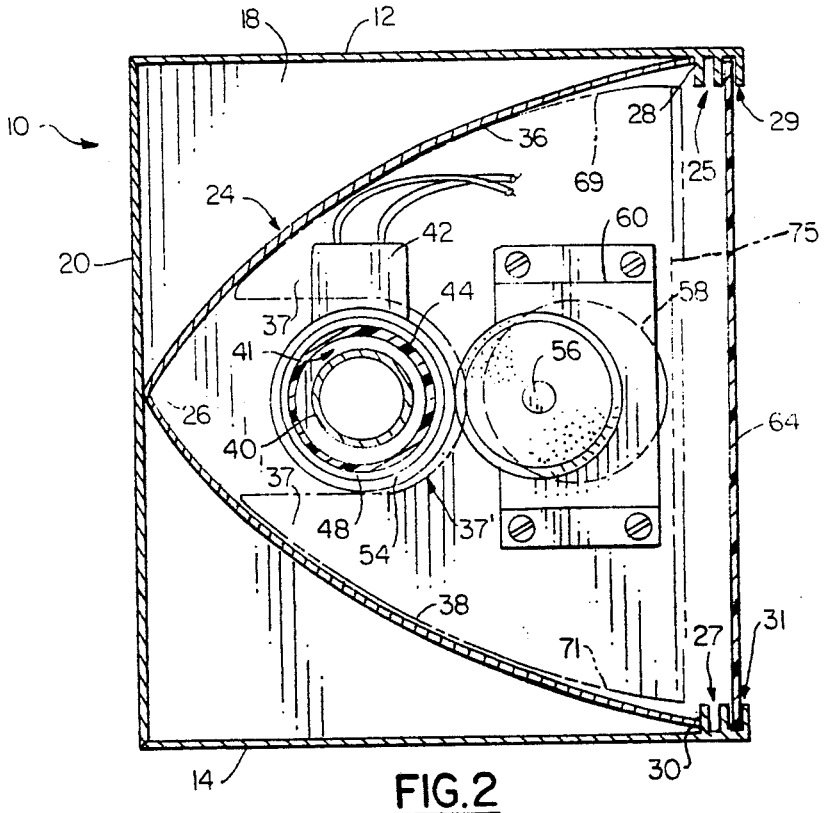
FIG. 2 is a side, elevated cross-sectional view of the invention taken generally along the line 2—2 in FIG. 1.
Figure 3:
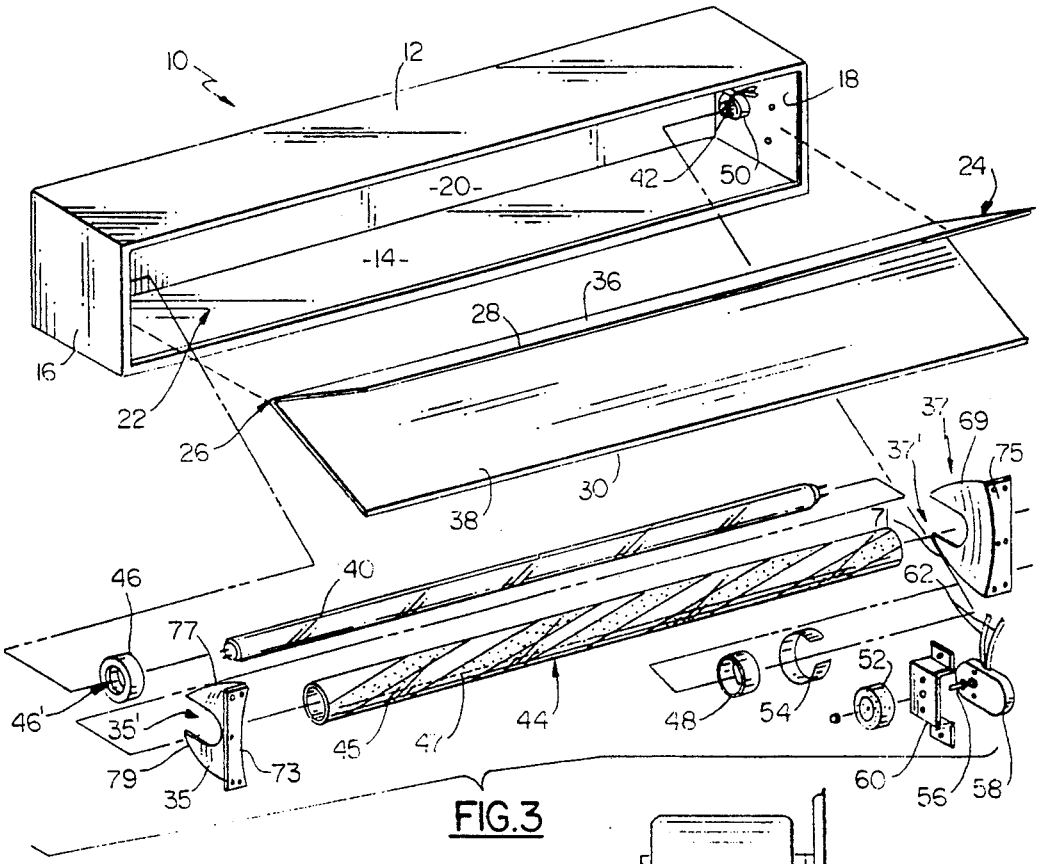
FIG. 3 is an exploded, perspective view of the invention absent the front panels seen broken away in FIG. 1.
Figure 5:
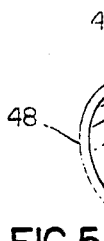
FIG. 5 is a perspective view of a sleeve collar.
Figure 4:
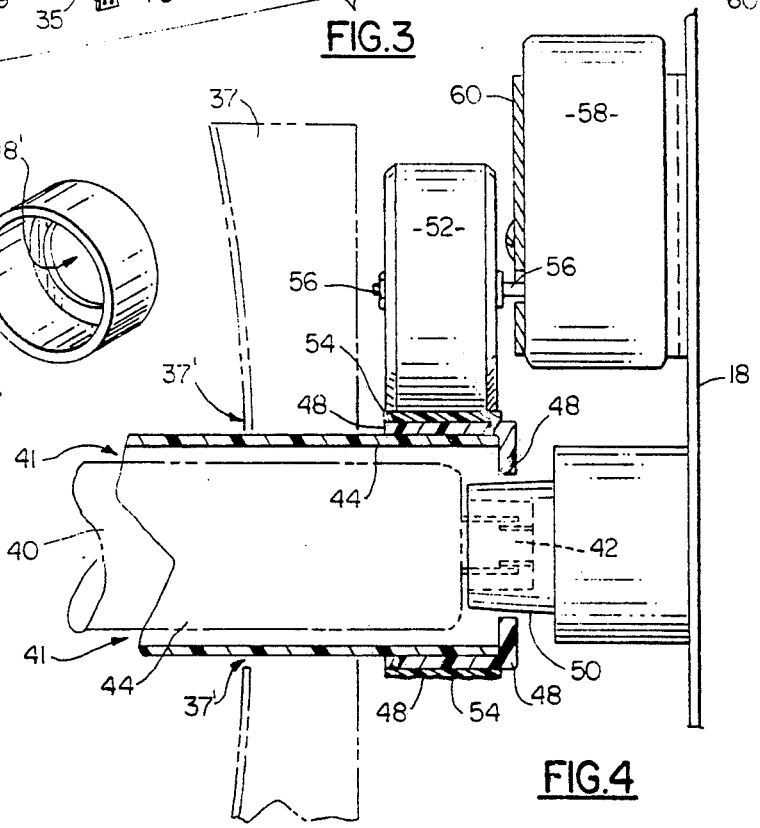
FIG. 4 is a front elevational view of the light tube and sleeve rotating assembly of the invention with some components shown in section.

Positioned forward of and adjacent to reflective panel 24 is fluorescent light tube 40 which plugs into conventional electrical sockets 42, one socket 42 (not shown) mounted on side walls 16, and one socket 14 mounted on side wall 18 of housing 10 (FIGS. 3, and 4). As seen best in FIG. 2, light tube 40 is positioned approximately midway between top and bottom reflective panel lengths 36 and 38, directly in front of panel crease 26 to a person looking straight into housing open front 22.

Prior to insertion of tube 40 into housing 10, a tubular sleeve 44, having a diameter approximately an inch larger than tube 40's diameter, is fit around but does not contact tube 40 as evidenced by open space 41 seen in FIGS. 2 and 4. The spacing of sleeve 44 about tube 40 is accomplished by like sleeve collars 46 and 48 having respective annular openings 46' and 48' which are frictionally yet releasably secured to each end of sleeve 44. As seen best in FIG. 4, one end of tube 40 passes through collar opening 48' (and 46' on the opposite side) to plug into each electrical socket 42, one socket 42 (not shown) on side wall 16, and one socket 42 on side wall 18. Immediately surrounding both outlets 42 is an annular member 50 (member 50 on wall 16 also not shown), over which fits openings 46' and 48' of collars 46 and 48. The fit of openings 46' and 48' of collars 46 and 48 about respective members 50 is not frictionally sufficient to prevent movement of collars 46 and 48 about members 50 such that collars 46 and 48 may be supported by and rotate freely about members 50, thereby rotating sleeve 44 about tube 40 (upon proper actuation described below), since collars 46 and 48 are frictionally secured to the ends of sleeve 44.

Rotation of collars 46 and 48 about members 50 is effectuated by the turning of rubber wheel 52 which is positioned in frictional contact with abrasive outer layer 54 of collar 48. Wheel 52 rotates about shaft 56 of motor 58 attached to side wall 18 of housing 10 by means of bracket 60. Motor 58 includes wiring 62 which is supplied electricity via an outside source (not shown).

Sleeve 44 is seen to include stripes 45 and 47, which are preferably of contrasting, bright colors such as red and green, sleeve 44 and stripes 45 and 47 being translucent such that light emitted from flourescent tube 40 is allowed to pass through sleeve 44. As aforementioned, sleeve 44 is releasably attached to collars 46 and 48 thereby permitting interchangeability of a plurality of sleeves 44 of varying colors and patterns as desired. As rubber wheel 52 turns and frictionally engages layer 54 of collar 48, sleeve 44 rotates about stationary tube 40 and emits what is visually perceived to be moving, colored light. This "moving colored light" emitted from rotating sleeve 44 impinges upon reflective panel 24 to reflect the light toward open front 22 of housing 10. As aforementioned, side panels 35 and 37 include respective slots 35' and 37'. As such, panels 35 and 37 may be fit around each end of sleeve 44 following positioning of sleeve 44 about tube 40. As seen best in FIG. 2, panel 37 is configured such that its outer edges 69 and 71 contact concave lengths 36 and 38 of panel 24, respectively, when in place in housing 10 as seen in FIGS. 1, 2 and 4, concealing motor 58 and wheel 52 on wall 18. Panel 35's outside edges 77 and 79 likewise contact concave lengths 36 and 38 of panel 24, respectively (not shown), when in place in housing 10 adjacent wall 16. The main portion of panels 35 and 37 which have slots 35' and 37', bend slightly concavely inward when viewed through open front 22 and include a front edge which bends substantially 90° therefrom and includes respective riveted, rigid strips 73 and 75 which lie substantially parallel to rear wall 20 when properly positioned about sleeve 44. Panels 35 and 37 thus act to reflect light impinged upon its' surfaces from tube 40 and rear panel 24, as well as to conceal the motor and wheel assembly on wall 18.

A first message panel 64 seen in FIGS. 1 and 2 is placed in open front 22 by inserting the two long edges of panel 64 into outer grooves 29 and 31 (FIG. 2) at either of the housing ends 16 or 18, and sliding panel 64 along the full length of housing 10 until panel 64 completely covers housing open front 22. First message panel 64 is seen to include transparent characters denoted generally by the reference numeral 66 incorporated into the otherwise opaque panel 64, the arrangement of transparent characters 66 of one's choosing comprising the message sought to be read by passersby. The moving colors emitted by sleeve 44 and reflected by reflective panel 24 and side panels 35 and 37 pass through transparent characters 66 of panel 64 to give panel 64 the visual effect that it is emitting characters of moving colors.

A second message panel 68 may be optionally used in combination with the first message panel 64 (not shown in FIG. 2). In particular, first panel 64 would be used by itself for instances when passersby would be able to view from a distance, since the colored light passing through transparent portions 66 will be quite bright. For instances when the passersby will be able to view the message up close, it would be desirous to "tone down" the brightness of the colored light. In this regard, panel 68 is made of a textured, translucent material which is positioned behind panel 64 along the inner grooves 25 and 27 of housing 10. The pattern of the texture of panel 68 may be varied but is preferred to create the appearance of "dotted" light as viewed through transparent portions 66 of first message panel 64.

What is claimed is:

1. Sign apparatus wherein a plurality of different colors are sequentially moved across a stationary display panel of visible indicia, said apparatus comprising, in combination:

a) a box-like enclosure having top, bottom, rear and opposite side walls and a frontal opening of predetermined length and width;

b) an elongated, electric light tube having opposite ends mounted to stationary supports respectively adjacent said opposite side walls, rearwardly of said frontal opening;

c) a cylindrical sleeve concentrically surrounding and spaced from said light tube, and extending between opposite ends over substantially the entire length of said tube, said sleeve having a plurality of discrete stripes of different colors, each of said stripes extending axially of said sleeve, all of said stripes permitting essentially undiffused passage of at least a substantial portion of the light from said tube;

d) support means by which said sleeve is mounted at its opposite ends for rotation about its axis;

e) motor means operative to impart rotation to said sleeve, said motor means being mounted inwardly adjacent one of said side walls;

f) first reflector means mounted internally of said housing, extending between opposite ends substantially the full axial length of said tube, and positioned between said sleeve and said top, bottom and rear walls of said enclosure to provide a forwardly directed surface from which light from said tube is reflected toward said frontal opening;

g) second reflector means including a first portion mounted inwardly adjacent said motor means, whereby said motor means is positioned between said first portion and said one of said side walls, and a second portion mounted inwardly adjacent the other of said side walls, said first and second portions having inwardly facing reflective surfaces extending from inner edges closely adjacent said sleeve to first outer edges closely adjacent said forwardly directed surface at opposite ends of said first reflector means and second outer edges closely adjacent said frontal opening; and h) at least one message panel mounted in said frontal opening of said enclosure and having substantially transparent and opaque portions defining a visual display whereby light emitted by said tube is transmitted through said sleeve, reflected by said first and second reflector means, and transmitted through said transparent portions of said panel to present a visual display with discrete color changes as said sleeve is rotated.

2. The sign apparatus of claim 1 and further comprising a second, translucent panel and means for removably mounting said second panel within said frontal opening in closely superposed relation to said message panel.

3. The sign apparatus of claim 2 wherein said second panel has a textured surface, whereby said visual display has a textured appearance of lower brightness when said second panel is positioned in said superposed relation to said first panel.

4. The invention according to claim 1 wherein said light tube stationary supports comprise electric sockets having cylindrical, outer surfaces, and said sleeve support means comprise a pair of annular collars respectively mounted upon said sleeve opposite ends and having an inwardly directed flange having inner edges defining a circular opening of substantially the same diameter as said socket outer surfaces, said flange inner edges respectively engaging said socket outer surfaces for rotatable support thereon.

5. The sign apparatus of claim 4 wherein said motor means rotates a wheel having an outer surface fictionally engaging one of said annular collars, thereby imparting rotation to said one collar and said sleeve.

6. The sign apparatus of claim 1 wherein each of said first and second portions of said second reflector means include open-ended slots embracing said sleeve and defining said inner edges.

7. The sign apparatus of claim 6 wherein each of said first and second portions of said second reflector means include flange portions adjacent said second outer edges for mounting said second reflector means to said enclosure.

* * * * *